US007172085B2

(12) United States Patent
Beaudette

(10) Patent No.: US 7,172,085 B2
(45) Date of Patent: Feb. 6, 2007

(54) SQUEEZABLE, FILLABLE FEEDING DEVICE

(76) Inventor: Susan A. Beaudette, 2733 E. Coolldge Ave., Orange, CA (US) 92867

( * ) Notice: Subject to any disclaimer, the term of this patent is extended or adjusted under 35 U.S.C. 154(b) by 390 days.

(21) Appl. No.: 10/309,687

(22) Filed: Dec. 4, 2002

(65) Prior Publication Data

US 2003/0132185 A1 Jul. 17, 2003

Related U.S. Application Data

(60) Provisional application No. 60/338,475, filed on Dec. 4, 2001.

(51) Int. Cl.
*A61J 9/00* (2006.01)
*A61J 11/00* (2006.01)

(52) U.S. Cl. ..... 215/11.1; 215/11.4; 215/229; 220/705; 220/709; 604/77; 604/79

(58) Field of Classification Search ..... 215/11.1, 215/388, 229; 604/77, 79; 220/705, 709
See application file for complete search history.

(56) References Cited

U.S. PATENT DOCUMENTS 2,600,978 A * 6/1952 DeMarco ..... 215/11.1
3,153,415 A * 10/1964 Sheridan ..... 604/256
3,172,561 A * 3/1965 Schwartz ..... 220/709
3,645,262 A 2/1972 Harrigan
3,757,784 A * 9/1973 Avery ..... 604/76
4,153,170 A * 5/1979 Aquarian ..... 215/11.1
4,463,859 A * 8/1984 Greene ..... 215/11.1
4,505,310 A * 3/1985 Schneider ..... 141/114
4,629,098 A * 12/1986 Eger ..... 222/175
4,813,933 A 3/1989 Turner
4,898,290 A 2/1990 Cueto
4,966,580 A 10/1990 Turner et al.
4,969,564 A * 11/1990 Cohen et al. ..... 215/11.1
4,994,076 A * 2/1991 Guss ..... 606/236
5,048,705 A * 9/1991 Lynd et al. ..... 215/388
5,049,127 A * 9/1991 Yen Tseng ..... 604/79
5,057,077 A 10/1991 Turner et al.
5,105,956 A * 4/1992 Tarng-Lin ..... 215/11.1
5,215,231 A * 6/1993 Paczonay ..... 222/610
5,221,016 A * 6/1993 Karpal ..... 215/12.2

(Continued)

FOREIGN PATENT DOCUMENTS

GB 2270684 A * 3/1994

*Primary Examiner*—Sue A. Weaver
(74) *Attorney, Agent, or Firm*—Harleston Law Firm LLC; Kathleen M. Harleston

(57) ABSTRACT

An easy to use, squeezable device with a soft, flexible tube for feeding liquid nutrition to a person, includes:

a) a squeezable bottle portion for holding the ingestible liquid therewithin, the bottle portion comprising an opening at its top surrounded by a neck; and b) a cap assembly comprising: flexible fluid-flow tubing, a spout or nipple assembly, and a threaded collar, an upper portion of the spout assembly being insertable through a central aperture in the collar, the flexible tubing having a first end in fluid communication with the bottle portion and a second end insertable in the patient's mouth, the flexible tubing extending through or encircling a central aperture in the spout assembly. The spout assembly preferably includes a leakproof flange, and a valve assembly for controlling flow. The device is particularly intended for use where suction such as nipples, straws, or sip cups are contraindicated after craniofacial surgery.

4 Claims, 11 Drawing Sheets

U.S. PATENT DOCUMENTS 5,234,117 A * 8/1993 Garvin ..... 215/11.4
5,388,712 A * 2/1995 Brody ..... 215/229
5,398,853 A 3/1995 Latham
5,439,125 A * 8/1995 Bloch ..... 215/229
5,462,101 A 10/1995 Mouchmouchian
5,478,325 A 12/1995 Fu-Hsiang
D378,975 S 4/1997 Reid
5,682,931 A 11/1997 Mouchmouchian
5,693,033 A 12/1997 Nita
5,749,483 A 5/1998 Tebeau
5,873,474 A 2/1999 Gray
5,890,636 A 4/1999 Kibbe
6,076,967 A 6/2000 Beaudette
6,126,679 A * 10/2000 Botts ..... 606/236

* cited by examiner

SQUEEZABLE, FILLABLE FEEDING DEVICE

CROSS REFERENCE TO RELATED DOCUMENT

This invention was described in provisional U.S. patent application Ser. No. 60/338,475, which was filed in the U.S. Patent & Trademark Office on Dec. 4, 2001.

BACKGROUND OF THE INVENTION

1. Technical Field

The present device relates generally to a squeezable, collapsible, disposable and/or reusable bottle device with flexible tubing for dispensing liquid nutrition or the like to post-surgical maxillo, craniofacial, and other reconstruction patients.

2. Background Information

Physicians prohibit infants and children who have had surgery for a cleft lip or cleft palate from breast feeding or sucking on a nipple or straw, so it is difficult to feed them. Suction on any feeding device is contraindicated after such reconstructive surgery. Currently, such infants are fed using a piece of tubing inserted over the open end of a syringe. A syringe with tubing is used so as not to disrupt, traumatize, or break open swollen, sutured tissue in the palate and/or lip. Suction, as occurs on a nipple, is contraindicated because it can cause bleeding, hematomas, dislodged sutures, and otherwise impair healing. The tube extending from the syringe must be inserted along the left or right side of the infant's mouth so as not to disturb the sutures and wound site.

There are many problems with syringe feeding. First, a filled syringe is very difficult to manipulate. It takes both hands to fill the syringe and dispense the viscous formula through it. It is difficult to control pressure on the syringe plunger so that the correct amount of fluid is dispensed into the child's mouth. Dispensing too much fluid too fast can cause the child to gag or spit up. Holding the baby and depressing the syringe at the same time is awkward.

Second, syringes generally hold only a limited amount of formula and must be repeatedly refilled during a single feeding. These infants are fussy and often in pain from the surgery and they are disturbed by the repeated halts in their feeding. Refilling the syringe is messy and inconvenient, especially in a hospital room or nursery.

Third, the baby moves around during feeding and the tubing sometimes comes loose from the syringe. Then the loose tube is a hazard in the baby's mouth, and the baby's wet shirt must be changed.

Fourth, feeding becomes more of an uncomfortable medical procedure when it is done with a syringe. Many hospitalized children associate a syringe with painful shots and become belligerent when they see a syringe. Syringe feeding can be intimidating for both the parent and the child. The child must be fed several times per day, and the disadvantages of this type of feeding make feeding time a chore for both the baby and the stressed mother or other caregiver. The baby expends a great deal of energy resisting feeding, and the mother or other caregiver is worn out. Feeding time should instead be a soothing experience for these babies and their mothers.

The same types of problems are encountered in feeding other post-surgical patients who have had maxillo or craniofacial surgery, or who are simply infirm or unable to feed normally due to medical problems of the face or mouth. The problems are further aggravated in that some of these babies and children must undergo repeated reconstruction as they grow. For example, children with a cleft palate often have to return to the hospital for surgery several times between the ages of three weeks and about two years.

BRIEF SUMMARY OF THE INVENTION

The present invention is a squeezable, disposable or refillable device with a flexible tubing for feeding liquids to a patient who has had maxillo, craniofacial, or related types of reconstruction surgery, or has other facial impairments. The feeding device includes:

a) a bottle portion for containing the ingestible fluid, the bottle portion comprising an opening at its top surrounded by a neck having exterior threads; and b) a cap assembly comprising: flexible, fluid-flow tubing, a spout or nipple assembly, and a threaded collar, the tubing extending through or encircling a central aperture in the spout or nipple assembly, an upper portion of the spout or nipple assembly being insertable through a central aperture in the collar, the collar having interior threading engageable with the correspondingly threaded neck of the bottle portion, the collar extending down over the neck; wherein the tubing is insertable into the mouth of the patient.

The present invention also includes a bottle device for feeding liquid nutrition to a patient or for teaching a patient to suck, comprising:

a) a squeezable bottle portion for holding the ingestible fluid therewithin, the bottle portion comprising an open top surrounded by a neck; and b) a leakproof cap assembly comprising: a spout assembly, a collar, and fluid conducting tubing, the collar comprising corresponding interior threads for removably interengaging the neck of the bottle portion; the spout assembly comprising a peg on its upper portion and a flange on its lower portion, the peg extending in an upward direction through a central aperture in the collar, the fluid-conducting tubing having a first, upper end that is insertable into a mouth of the patient and a second, lower end that is removably attachable over the peg, the flange extending closely into the open top of the bottle portion for preventing leaks, a portion of the spout assembly being mounted on the neck of the bottle portion, the spout assembly comprising a central channel for conducting fluid from the bottle portion to the tubing.

Advantages of the present invention for a baby or older patient include the following:

a) the squeezable bottle and flexible tubing allow passive administration of fluids while preventing suction by the patient and injury to the surgical site;

b) the tubing portion of the present invention can easily be inserted in the side of the patient's mouth without being dislodged;

c) the feeding device does not physically disrupt the sutures or swollen tissue in the jaw, palate or lip, and is very unlikely to cause trauma to the surgery site;

d) the bottle portion of the present invention holds enough for a full feeding;

e) the bottle portion is squeezable for administering the fluid in the bottle, so the mother can hold the baby and feed him or her at the same time, and fluid volume can be easily controlled;

f) the baby can also grasp the bottle portion without adverse consequences;

g) the baby and caregiver are more comfortable during feeding times, and feeding is effortless and more enjoyable for both;

h) the present invention is more natural looking and less surgical in appearance, which is important to both parent and child;

i) the present invention is inexpensive and refillable or disposable;

j) formula, pureed food, and other types of fluids are passively and effortlessly dispensed to the patient;

k) the present feeding device simplifies the ingestion of liquid nutrition, so the patient consumes more nutrients, and there are fewer postoperative complications, such as weight loss and dehydration; and l) the present invention is versatile and can be used by patients of any age. With the present feeding device, feeding times can be close to normal, even though the abnormal (hospital) environment remains.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein.

DETAILED DESCRIPTION OF THE INVENTION

Figure 1:
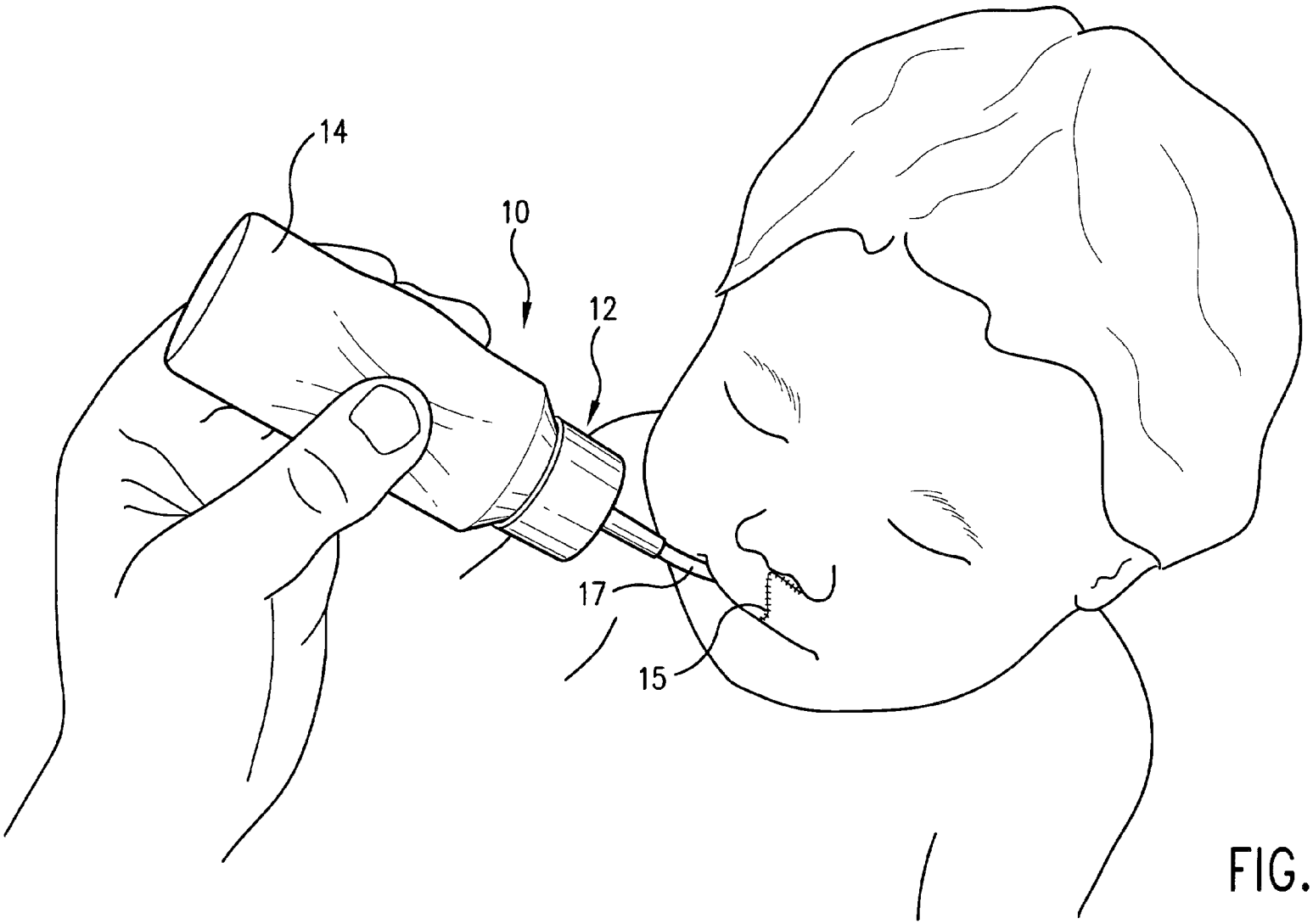
FIG. 1 shows a perspective view of a feeding device according to the present invention, shown in use.

In the following description, like reference characters designate like or corresponding parts throughout the several views. Also, in the following description, it is to be understood that such terms as "front," "back," "within," and the like are words of convenience and are not to be construed as limiting terms. Referring in more detail to the drawings, the invention will now be described.

Referring to FIG. 1, a feeding bottle device, generally referred to as 10, of the present invention comprises a cap assembly 12 and a bottle portion 14. A soft, flexible, medical-type tubing 17 extends into the baby's mouth from the cap assembly 12. In FIG. 1, formula is being fed to a baby who has had surgery for a cleft lip and/or palate. Sutures 15 on the child's upper lip indicate in FIG. 1 where the cleft lip has been repaired. This invention is a feeding device of the baby-bottle type having a squeezable, or collapsible, bottle portion 14 adapted for feeding post-surgical patients who have had a lip, palate, or jaw reconstruction, where the sucking of nipple feeding devices, sipping cups, or conventional straws are contraindicated. The bottle device can be used to feed the baby, or other patient, any fluid or liquid, whether thin or viscous, such as formula, milk, apple juice, and even medication, which is often difficult to administer to a fussy baby.

Figure 2:
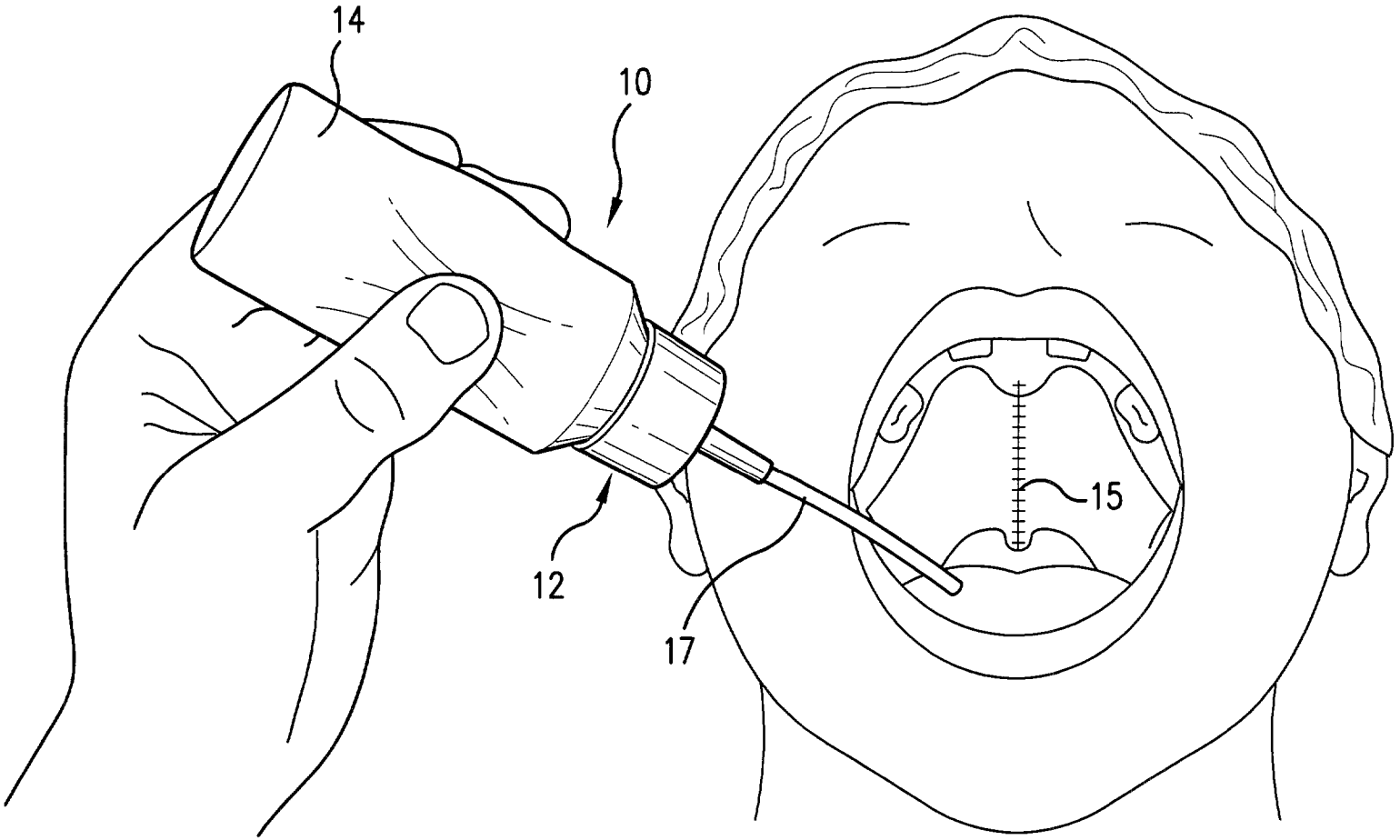
FIG. 2 shows a perspective view of a feeding tube of a feeding device according to the present invention, shown in use.

FIG. 2 shows the first embodiment of the feeding device 10 in the mouth of a child with a sutured palate. Sutures 15 typically extend along the longitudinal centerline of the child's upper palate, as shown in FIG. 2. During feeding, the tubing 17 is placed along the left or right side of the baby's mouth to keep the sutured wound as clean as possible so that it can heal quickly with as little infection as possible, and to prevent the bottle device 10 from physically interfering with the sutures or the wound site, which could cause bleeding from the incision and pain. The tubing 17 is soft and flexible so that it is comfortable in the baby's mouth.

Figure 3:
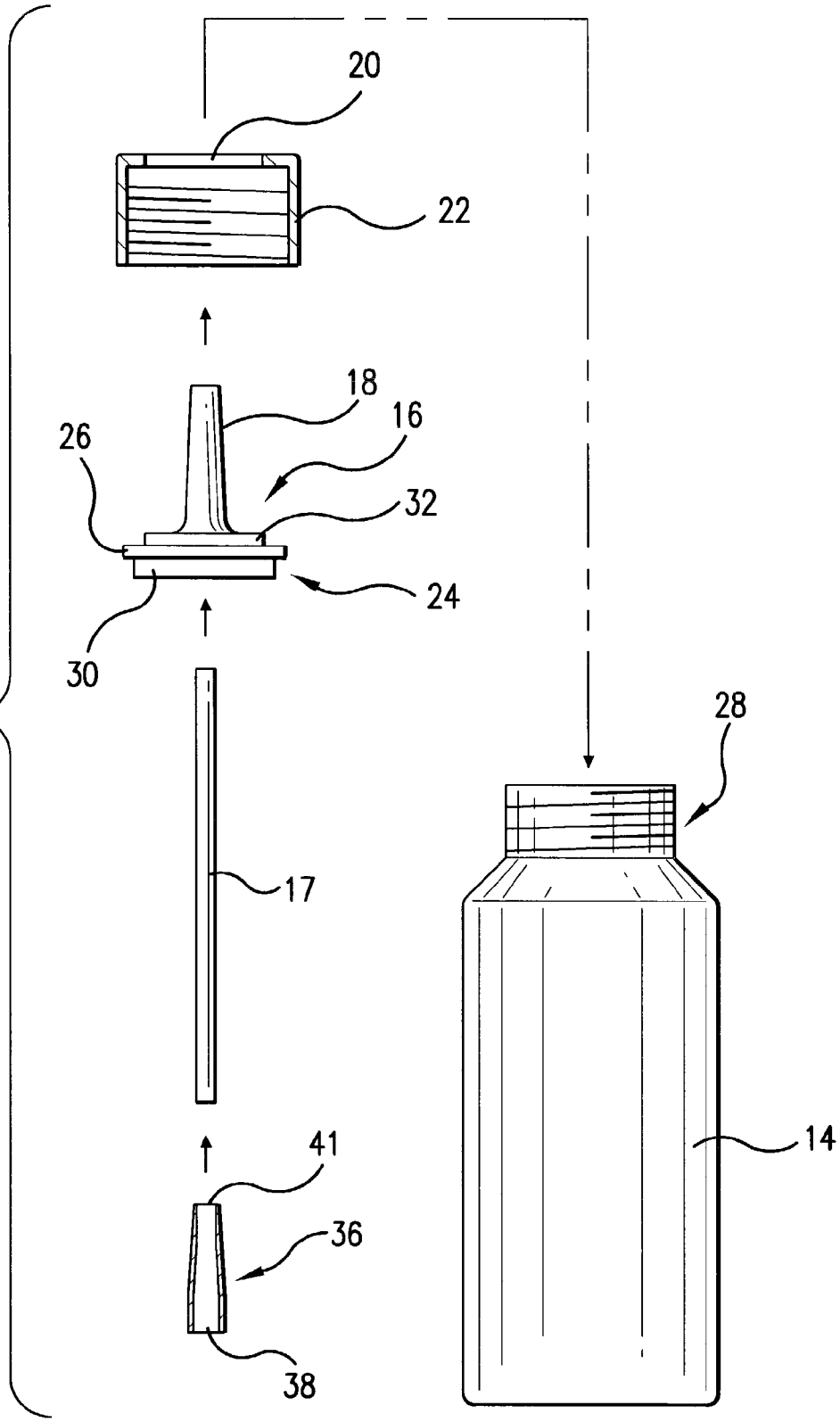
FIG. 3 is a cross-sectional side view of the first embodiment of the feeding device according to FIG. 1, showing the various parts.

Various parts of a preferred embodiment of the feeding bottle device 10 are shown in FIG. 3. The cap assembly 12 includes a spout 16, an upper portion 18 of which is insertable (capable of being inserted) through a circular aperture 20 in a threaded collar 22. A lower portion 24 of the spout 16 includes a circular flange 26. "Upper" and "lower" herein refer to positions when the bottle device 10 is upright, as it would be when it is placed on a table. When the bottle device 10 is assembled, the upper spout portion 18 extends through the collar aperture 20, while the lower spout portion 24 remains within the collar 22. The spout flange 26 extends across the width of the collar 22. The threaded collar 22 is adapted to screw, or snap, over a correspondingly threaded neck 28 of the squeezable bottle portion 14 to prevent leaking of the bottle contents. The bottle neck 28 surrounds an open mouth. When the cap assembly 12 is screwed onto the bottle portion 14, a circular base 30 of the spout 16 extends a short distance down from the flange 26 into the mouth of the bottle. The flange 26 sits on top of the bottle neck 28. The lower spout portion 24 also includes a circular band 32 extending in an upward direction from the spout flange. The spout band 32 fits into the collar aperture 20. The collar aperture 20 and the spout band 32 have approximately the same diameter. The spout base 30 and spout band 32 have a diameter which is slightly less than the diameter of the spout flange 26. The band 32, flange 26, and base 30 block fluid from bypassing the spout 16 and leaking from the collar 22.

Continuing with FIG. 3, the cap assembly 12 includes the soft, flexible feeding tube 17, which passes through the hole that extends through the spout 16. The medical tubing 17 extends several inches beyond the mouth of the bottle portion 14, preferably about six inches. The tubing 17 or spout 16 is long so that the fluid from the bottle bypasses most of the wound site and sutures in the patient's lip and upper palate. This is to keep the wound as clean as possible so that it can be as infection-free as possible, and heal as quickly as possible. During feeding, the tubing 17 is placed along the left or right of the baby's mouth. The tubing 17 is soft and flexible so that it is comfortable in the baby's mouth. Also, the baby is unlikely to suck on the tubing when it is placed along the side of the mouth. Physicians discourage sucking because of possible attendant damage to the stitched lip and/or palate. For this reason, the diameter of the tubing of the present invention is preferably large enough to pass viscous liquid, such as baby formula, but not so large that it induces the child to suck on it. The present invention is also versatile in that the tubing 17 can be cut to the desired length. Where medicine is being administered using the present bottle device, a longer tubing can be used to extend to the back of the child's mouth, so that it bypasses the tongue and the child will not be as resistant. Nonliquid medicine should first be dissolved in a fluid that is capable of being ingested and digested ("ingestible") before being administered through the present feeding device.

The cap assembly 12 of the preferred embodiment illustrated in FIG. 3 also includes a flared tubing section 36. The aperture in the flared tubing section 36 is wider at the base 38 of the tubing section than it is at the upper end 41 of the tubing section. Also, the flared tubing base 38 is wider than the upper end 41 of the flared tubing section 36. The tubing section 36 is affixed to the lower end of the tubing 17. The flared, wide lower end of the tubing section 36 prevents the tubing 17 from inadvertently slipping out of the aperture in the upper end of the spout 16. Alternatively, the flexible feeding tube 17 itself has a flared lower end (rather than a separate flared tubing section) to prevent it from inadvertently slipping out of the aperture in the upper end of the spout 16. When the feeding bottle device 10 is in use, fluid flows from the mouth of the bottle portion 14 into the spout 16 through the tubing 17 into the patient's mouth.

In this preferred embodiment, the separate tubing is advantageous because it can be replaced after use. Alternatively, the entire bottle device 10 may be disposable, or it can be cleaned and refilled for more feedings with the same patient. The bottle portion typically holds about four to ten, preferably eight, ounces of liquid. It is preferably includes calibration lines so that the caregiver can assess how much of the fluid the infant, or patient, has consumed.

The collar 22 and spout 16 may be made of molded silicone, synthetic or natural rubber, or other suitable material. Alternatively, the spout 16 may be comprised of several pieces that are affixed to one another. The tubing is made of a conventional soft, flexible tubing material. The body of the bottle portion is made of a soft, collapsible plastic, such as a polyethylene.

The present invention is also useful for feeding geriatric patients who have had strokes, periodontal patients, patients with oral, or pharyngeal cancers, or general weakness at the front of the mouth, etc. These patients may be in hospitals, clinics, extended care facilities, or under home care.

Second Embodiment

Figure 4:
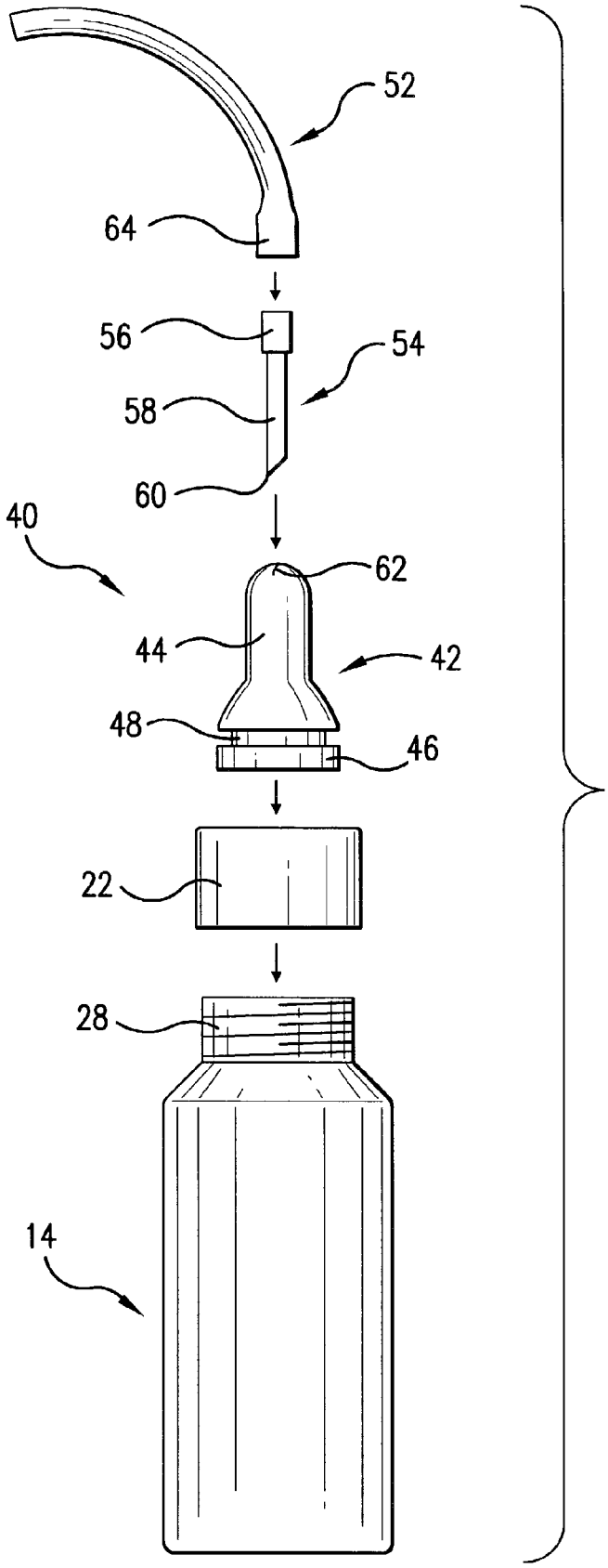
FIG. 4 is an elevational view of a second embodiment of a feeding device according to the present invention, showing the various parts.

Turning to the alternate embodiment 40 shown in FIG. 4, the cap assembly 12 comprises a threaded collar 22 adapted to screw onto the neck 28 of the bottle portion 14. Again, the neck has a diameter that is slightly less than the inner diameter of the collar 22. The cap assembly 12 includes a nipple assembly 42. An upper portion of the nipple assembly 42 is formed as a soft nipple 44. A lower portion of the nipple assembly 42 includes a flange 46, with a band 48 between the flange and the nipple 44. The flange 46 has a diameter approximately equal to the inside diameter of the collar 22. The band 48 has a diameter that is approximately equal to the diameter of the aperture in the top of the collar 22. The flange 46 and band 48 are preferably a relatively hard plastic and the nipple 44 is preferably substantially made of silicone or a rubber-type material. To assemble the bottle device 10, the nipple assembly 42 is inserted through the collar 22. The soft nipple flexes as it is pushed through the collar aperture, while the band 48 lodges in the collar aperture, and the flange 46 remains just below the top of the collar 22. The band 48 and flange 46 block fluid from leaking through the collar aperture. Once the bottle is filled, the collar 22 is screwed onto the neck 28 of the bottle portion 14.

Continuing with FIG. 4, the cap assembly 12 further includes a tubing assembly 50, which is comprised of a curved piece of flexible medical-type tubing 52 and a straw section 54. The straw section 54 has a cylindrical upper end piece 56 having a wider diameter than the lower straw portion 58. The lower end 60 of the straw portion 58 is angled so that it is relatively sharp. To use the tubing assembly, the sharp lower end 60 of the straw portion 58 is pushed into a slit 62 in the upper end of the nipple 44. The slit 62 may be pre-formed in the nipple 44, or it may be made in the nipple by the user at the time of use using the sharp end 60 of the straw portion 58. Since it is made of rubber or the like, the slit 62 flaps closed when the straw portion is removed. The curved tubing 52 is preferably soft and flexible, and the straw portion is preferably made of a harder plastic. As shown in FIG. 4, the lower end 64 of the tubing 52 is enlarged so that it fits over the upper end piece 56 of the straw section 54.

Assembly-First Embodiment

Figure 5:
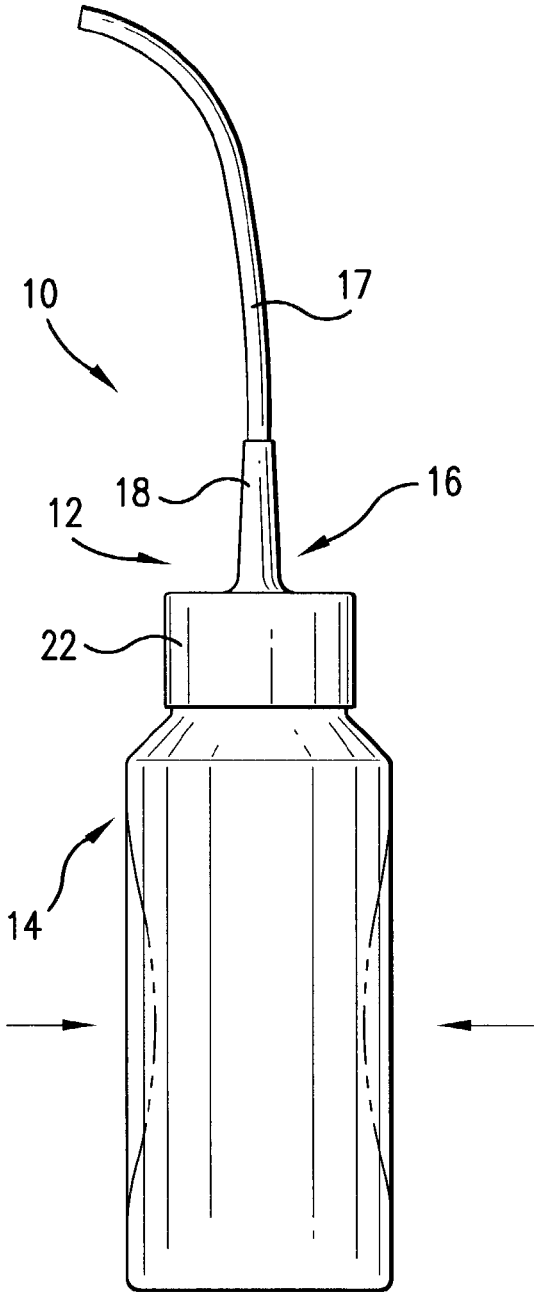
FIG. 5 is an elevational view of the first embodiment of the feeding device according to FIG. 3, showing the assembled bottle device.

For the first embodiment, the assembled, squeezable bottle device 10 is shown in FIG. 5. To assemble the bottle device of this embodiment, the upper end 41 of the flared tubing section 36 is pushed onto the lower end of the tubing 17. As indicated by the arrows in FIG. 3, the upper end of the tubing 17 is pushed through the central aperture of the spout 16. The upper spout portion 18 is pushed through the collar aperture 20. The upper spout portion 18 extends above the collar 22, while the lower spout portion 24 remains within the collar 22. The collar 22 is then screwed onto the neck 28 of the filled bottle portion 14 and the bottle device 10 is ready for use.

Assembly-Second Embodiment

Figure 6:
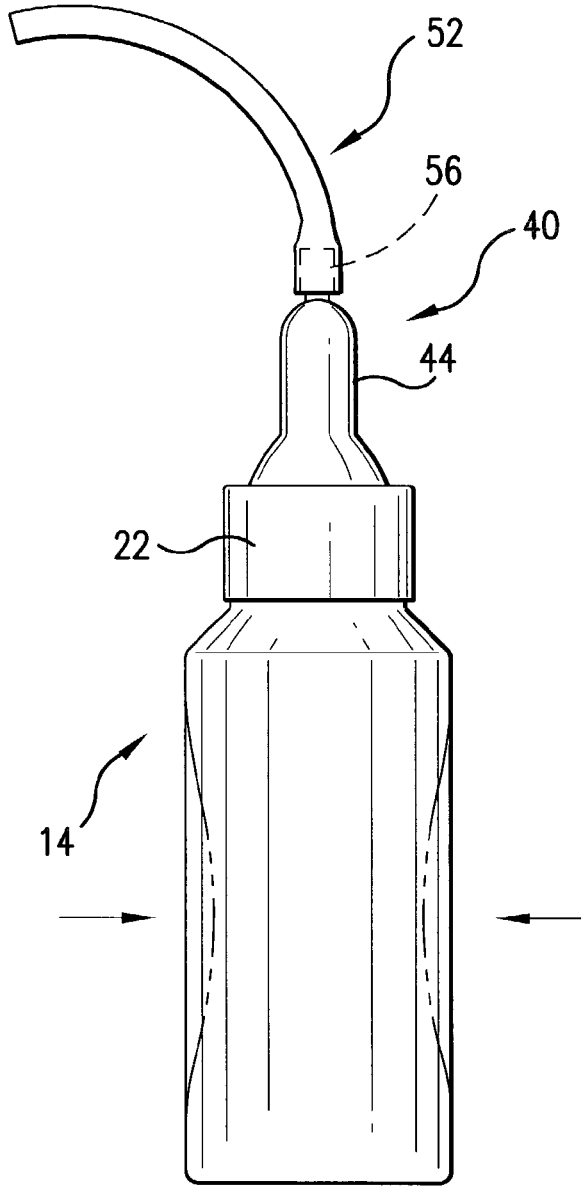
FIG. 6 is an elevational view of the second embodiment of the feeding device according to FIG. 4, showing the assembled feeding device.

For the second embodiment 40 of FIG. 4, the assembled squeezable bottle device is shown in FIG. 6. To further assemble the bottle device of this second embodiment, the enlarged end 64 of the curved tubing 52 is pressed down over the straw section 54. The sharp lower end 60 of the straw section is inserted into the self-closing slit 62 in the soft end of the nipple 44. The curved tubing 52 is easier to place in the baby's mouth when the baby is held in one arm and the bottle portion is held at a 45 degree angle with the caregiver's opposite hand. The nipple assembly provides a natural appearance, which is comforting to the caregiver and visitors, and it is soft to the touch so that it can safely brush against the child's face or be grasped by the child.

For the embodiments of both FIGS. 5 and 6, when the caregiver tips the bottle device downward, fluid flows from the bottle portion 14 into the spout 16 or nipple 44. The bottle portion is made of a soft, squeezable material, so that the fluid is forced out of the bottle portion into the tubing when the bottle portion is compressed. When the caregiver squeezes the bottle portion 14, as indicated by the arrows in FIGS. 5 and 6, fluid flows down the tubing 17, 52, and then into the baby's mouth or throat. To halt the flow of fluid, the caregiver stops squeezing, removes the tubing 17, 52 from the baby's mouth, and tips the bottle portion 14 up. The fluid and/or bottle device 10 can then be disposed of, or refrigerated for later use, or cleaned and refilled.

Third Embodiment

Figure 7:
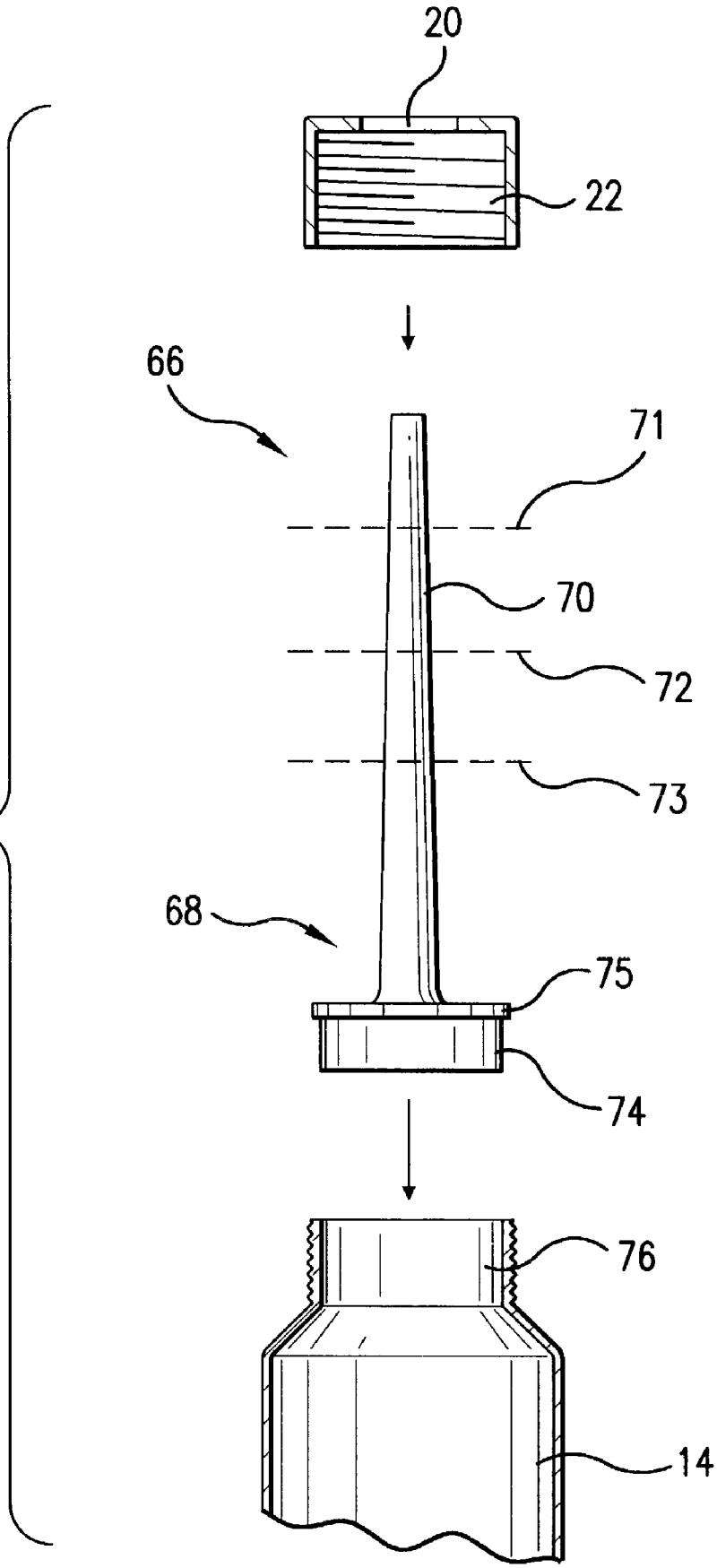
FIG. 7 is an elevational view of an upper portion of a third embodiment of a feeding device according to the present invention.

FIG. 7 shows an upper portion of a third alternate embodiment 66 of the present invention. This spout 68 has an extended upper spout portion 70, with three cut marks 71–73 marked on the outside of the upper spout portion 70. The cut marks indicate where the extended spout 68 can be cut, using a conventional cutting instrument, to obtain different rates of flow of the fluid in the bottle device. The upper cut mark 71 would be used to obtain a smaller diameter orifice for feeding an infant, or where the fluid is thin, for example. The lowest cut mark 73 could be used where a viscous fluid, such as a thick medication, is to be administered, or where the child is older and a liquefied blend of food is being fed to the child. Ideally, instructions would be given with the bottle device regarding the cut marks.

Continuing with FIG. 7, in this third embodiment 66, a lower portion of the extended spout 68 includes a flange 74 under a base 75. The base 75 has a greater diameter than the extended spout 68 or the flange 74. The flange 74 snaps or otherwise fits into a neck 76 of the bottle portion 14. The collar 22 is then placed over the top of the extended spout 68, so that the upper spout portion 70 extends through the collar aperture 20, and screwed onto corresponding threads on the outside of the neck 76.

Fourth Embodiment

Figure 8:
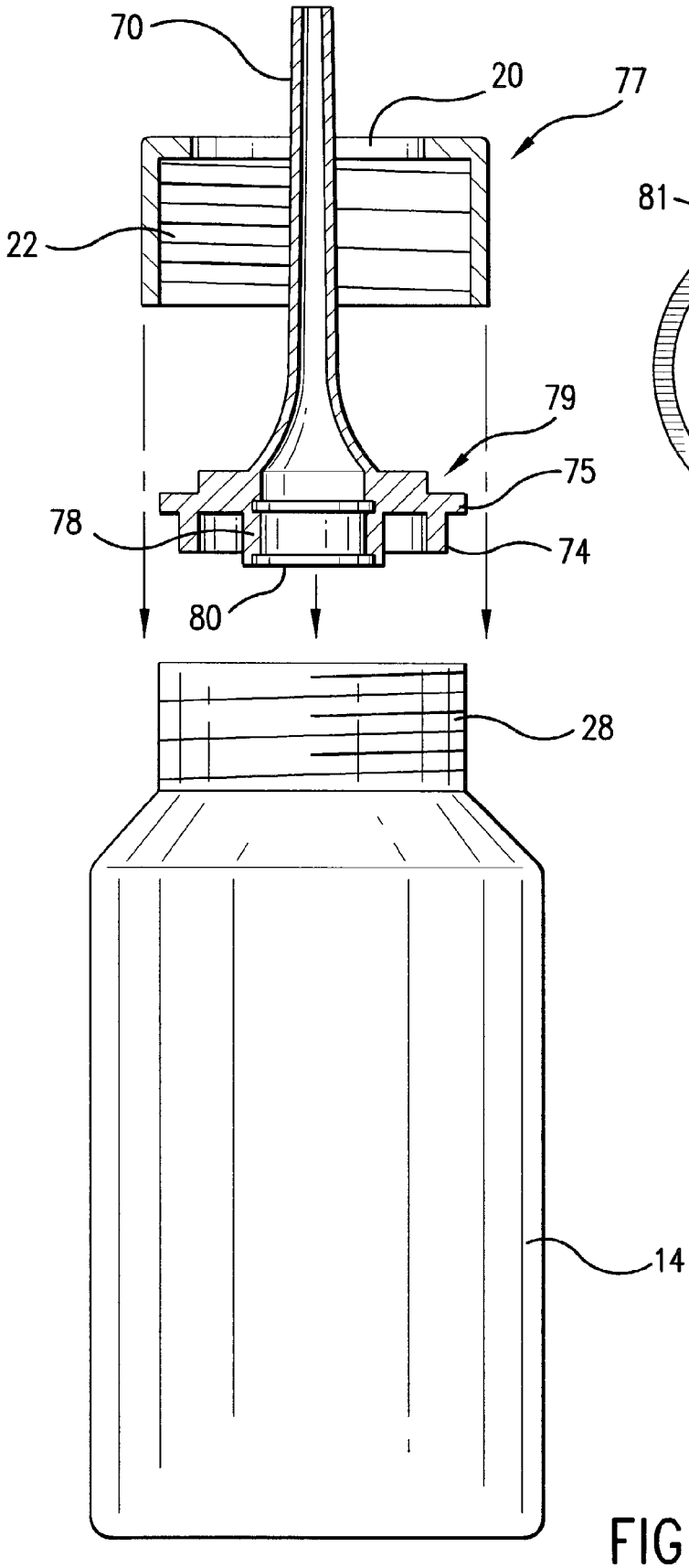
FIG. 8 is a partial cross-sectional side view of a fourth embodiment of the feeding device according to the present invention.
Figure 9:
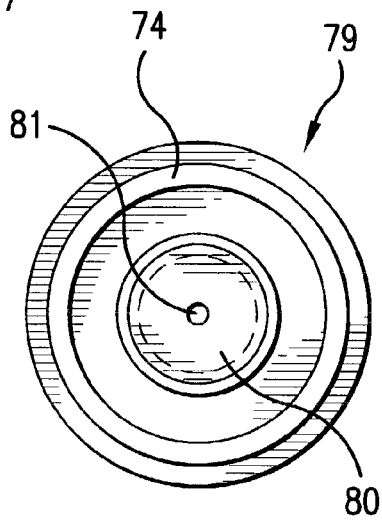
FIG. 9 is a bottom plan view of a spout portion of the fourth embodiment according to FIG. 8.

FIGS. 8 and 9 show a fourth alternate embodiment 77 of a feeding device according to the present invention. The feeding device 77 comprises a larger bottle portion 14 that can accommodate one or more full feedings, a threaded collar 22, a flanged spout 79, and a first valve 80. In use, the flange 74 on the bottom of the spout 79 fits closely inside the neck 28 to prevent leaking when the feeding device 77 is squeezed by the caregiver or baby. The part of the spout base 75 that extends beyond the outside of the flange 74 rests on the top edge of the bottle neck 28. An extended upper spout portion 70 of the flanged spout 79 fits up into an aperture 20 in the top of the threaded collar 22. The threads on the inside of the collar 22 correspond to the threads on the outside of the neck 28. The collar 22 fits down over the top of the flanged spout 79 and screws onto the threaded neck 28 of the bottle portion 14. In this embodiment, the soft, flexible tubing is incorporated into (continuous with) the upper end of the upper spout portion 70, forming one piece. Thus, in various embodiments of the instant feeding device: a) the tubing may constitute the upper portion of the spout (see FIG. 8); b) the tubing may be inserted up through the center of the spout or nipple (see FIG. 3); or c) the lower end of the tubing may be inserted via a straw into an orifice in the nipple (see FIG. 6) or be pushed over the outside of the end of the spout.

FIG. 9 shows a bottom plan view of the flanged spout 79 with the circular valve 80 in it. The valve 80 fits closely into a correspondingly sized, centrally located projection 78 at the bottom of the flanged spout 79. The valve 80 is preferably a silicone or rubber-type molded piece. The valve 80 has a central orifice 81, which is continuous with the bottle and the hole extending through the center of the spout. When the bottle portion 14 is squeezed, fluid from the bottle flows through the orifice 81 in the top of the valve 80 and down the extended upper spout portion 70 into the patient's mouth. When pressure on the bottle is released, the flow of fluid from the bottle into the patient's mouth ceases.

Fifth Embodiment

FIGS. 10A through 10D show the threading of tubing 83 in a fifth alternate embodiment 82 of the present invention. Since the tubing is made of a soft, flexible material, it is difficult to force it through an orifice in a nipple. This process remedies that problem. In this fifth embodiment 82, a straw 84 is placed through the bottom of a nipple assembly 85 (see FIG. 10A), which comprises a soft nipple 86, and pushed out through a small orifice 87 in the top of the nipple 86 (see FIG. 10B). In this embodiment, the upper end 89 of the straw 84 is cut at an angle to facilitate placement through the nipple orifice 87. The straw is preferably made of a hard plastic or the like. The tubing 83 is then threaded through the straw 84 from the bottom of the nipple assembly.

Figure 10D:
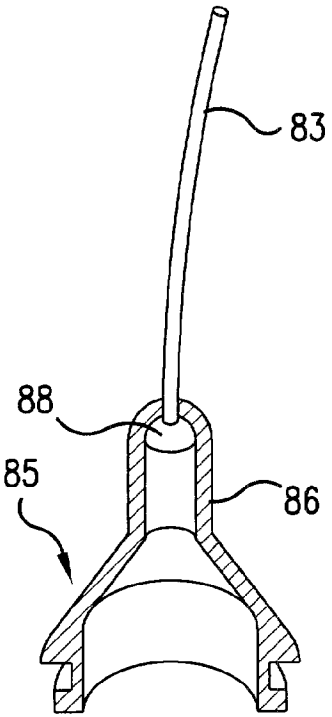
FIGS. 10A–D are cross-sections of a nipple assembly of a fifth embodiment of a feeding device according to the present invention, showing insertion of a tubing.
Figure 10C:
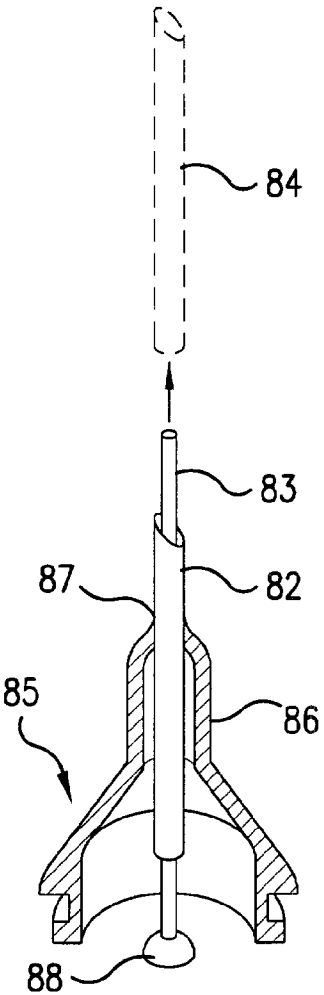
Figure 10B:
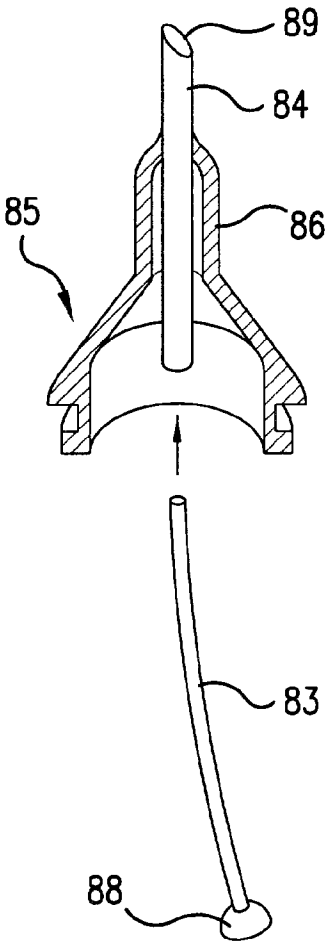
Figure 10A:
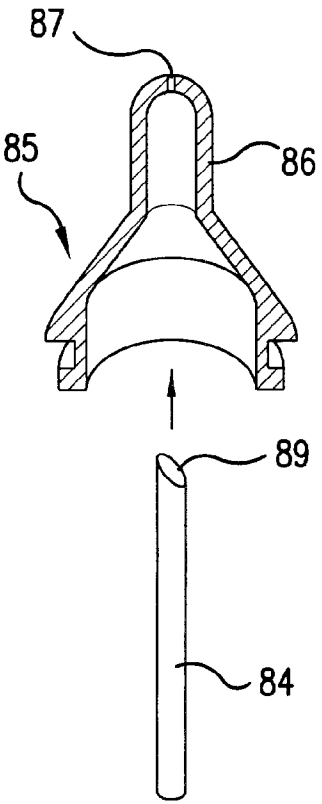
Figure 11:
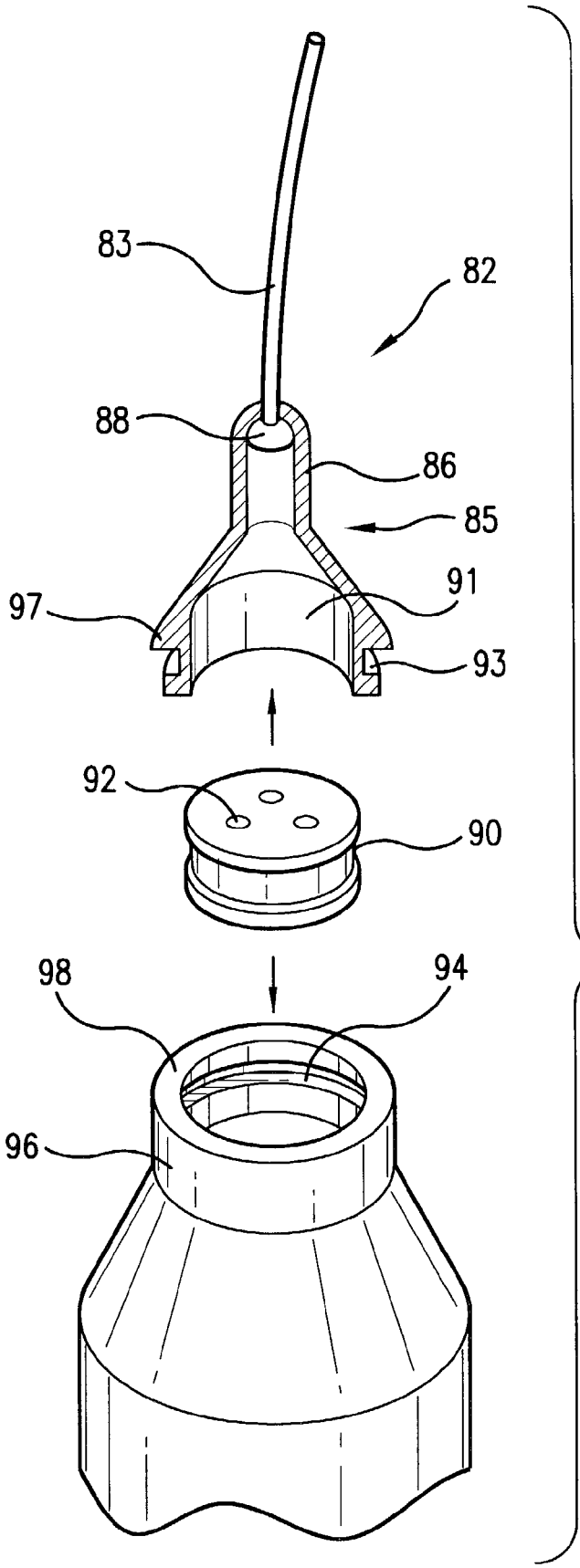
FIG. 11 is an elevational view of an upper portion of the fifth embodiment of a feeding device according to the present invention.

Finally, the straw 84 is removed by pulling it out of the orifice 87 from the top of the nipple assembly 85, as shown in FIG. 10C, leaving the tubing in place. As shown in FIG. 10D, at the opposite, lower end of the straw 84 is a hollow plug 88. The plug 88 anchors the tubing in the nipple 86, so that the tubing 83 does not slip out of the orifice 87. The hollow plug 88 accomplishes this without impeding the flow of liquid through the tubing FIG. 11 shows the nipple assembly 85 of the fifth embodiment 82, with the tubing 83, along with a second valve 90 and an upper portion of the bottle portion 14. The one-way valve 90 press fits into a matching space 91 at the base of the nipple assembly 85. The valve 90 is preferably a silicone or rubber-type molded piece. When the bottle portion 14 is squeezed, fluid from the bottle flows through two intersecting, self-closing holes 92 in the top of the valve 90. One hole, or three or more holes, can be utilized. When the user stops squeezing the bottle, the holes 92 flap closed, preventing backflow and control the rate of flow of fluid to the patient. With a valve, the fluid will not be dispensed unless and until the bottle portion is compressed.

Continuing with FIG. 11, once the second valve 90 is pressed up into the nipple assembly 85, a circular first projection 93 at the base of the nipple assembly is popped into a corresponding circular groove 94 inside the neck 96 of the bottle portion 14. The projection 93 fits closely into the matching groove 94 to prevent leaking. Once the nipple assembly is in place, a larger, second projection 97 around the nipple assembly and above the first projection rests on the top 98 of the bottle neck. The nipple assembly 85 and valve 90 are very easy to remove for cleaning. They can be boiled or cleaned with soap and water, and are disposable or reusable.

The cap assembly 12 can alternatively be made as a unitary molded piece including the tubing 32, 52, 83 (see FIGS. 5 and 6). The cap assembly may or may not include a valve. A unitary molded piece could have an outer rim to prevent leaks, and an inner rim for a flow valve to snap into. Nipples 44, 86 herein may be rounded, as shown in FIGS. 4, 6, 10 and 11, or flat at the top.

The present invention does not require an inner rod or inner ribbing. The nipple and/or spout are not insertable in the patient's mouth; the tubing is insertable.

Other suitable valves are also included herein. The cap assembly may comprise a valve device that includes a resilient member acting in conjunction with a movable valve member to control fluid flow from the bottle portion through the valve device.

The cap assembly may comprise a substantially flat, round disk structure with a slit, which is removably disposed against the top of the bottle portion in order to control fluid flow from the bottle portion through the tubing.

Kit

The present invention also includes a feeding kit for a child or feeding-disabled adult comprising a bottle portion 14, at least one tube 32, 52, 83, and at least one spout 16, 68 or nipple assembly 42, 85. A straw 84 may also be included for use in threading the tube through the nipple orifice 87. A straw section 54 may alternatively be included in the kit for connecting the tubing 32, 52 to a nipple 44, 86 of the nipple assembly.

Sixth Embodiment

FIGS. 12 through 16 illustrate a sixth alternate embodiment 100 of the present invention. This feeding device 100 allows patients of craniofacial surgery, deformities, facial trauma, or oral muscle weakness to consume liquids or pureed foods, even when sucking or using cups with straws is impossible. It is also effective for assisting speech pathologists to help children and adults (e.g., stroke victims, trauma victims) learn or re-learn how to suck on a straw. Alternatively, this bottle works very well for the same type of patients when sucking is contraindicated or impossible.

Figure 12:
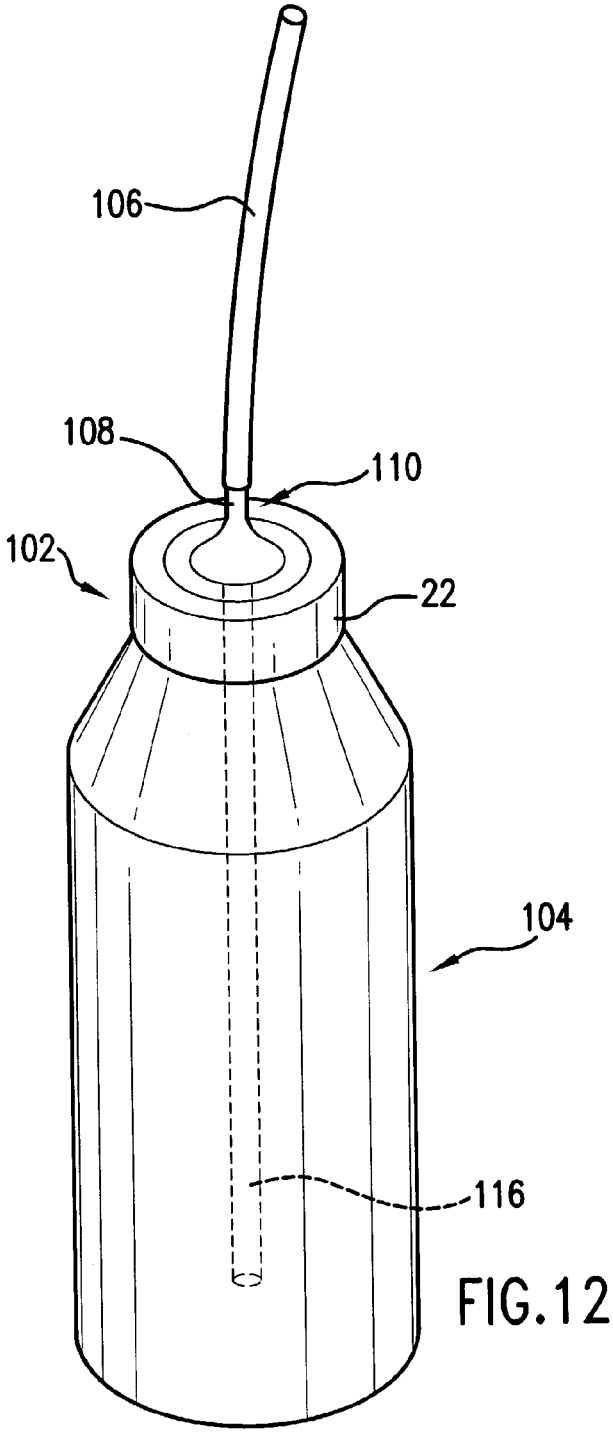
FIG. 12 shows a perspective view of a feeding device according to the present invention.
Figure 13:
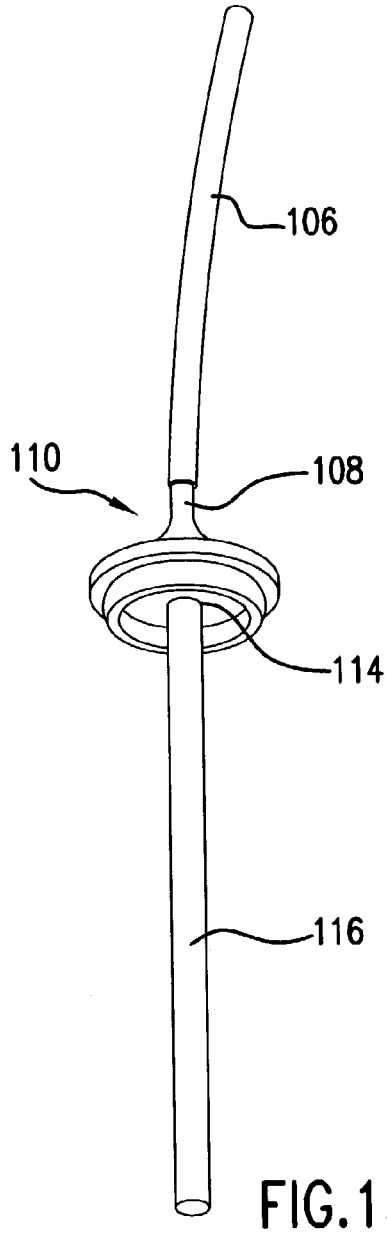
FIG. 13 shows a perspective view of a portion of the feeding device according to FIG. 12.

As shown in FIGS. 12 and 13, the feeding device 100 includes: a cap assembly 102 affixed to a soft, squeezable bottle portion 104 for containing the ingestible fluid. As discussed hereinabove, the bottle portion 104 comprises an open top surrounded by a neck. The cap assembly 102 comprises a section of flexible fluid-flow tubing 106 having a first end that is insertable in the patient's mouth. The soft tubing 106, which may be made of a polyvinyl chloride, protects the deformed or traumatized mouth, allowing food/liquid to bypass the sutured or weak area in the front of the mouth and be directed to the back of mouth to be swallowed.

Figure 20:
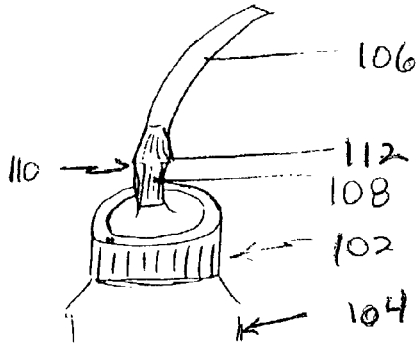
FIG. 20 shows a perspective view of a portion of a feeding device according to the present invention.

As shown in FIGS. 12 and 13, the opposite, second end of the tubing 106 is pressed down over the outside of a peg 108 on a spout assembly 110. This facilitates assembly and dis-assembly of the feeding device for washing, etc. The peg 108 preferably has a diameter that is slightly larger than the inside diameter of the tubing 106, so the second end of the tubing fits closely over the peg. The peg 108 may have the general shape of an arrow-head, as shown in FIG. 20, and preferably includes a projection 112. The projection 112 helps keep the second end of the tubing 106 from sliding back off the peg. In addition to the spout assembly 110, the cap assembly 102 includes a threaded collar 22 (see FIG. 12), which fits down over the correspondingly threaded neck of the bottle portion (as shown in FIG. 8).

As shown in FIG. 13, the spout assembly 110 includes a central channel 114 into which a first, upper end of a relatively rigid straw 116 is inserted. The spout assembly is preferably made of a strong yet flexible material. The first end of the rigid straw 116 closely fits into a lower opening of the channel 114 through the spout. The rigid straw is made of a harder plastic-type material than the soft tubing, though it too is somewhat flexible. The diameter of the peg, and the channel therethrough, may be narrow for thin fluids, such as water, or wider to accommodate more viscous material, such as pureed foods.

Figure 14:
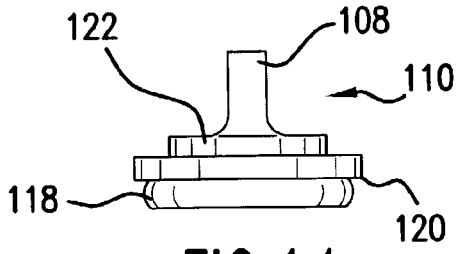
FIG. 14 shows a side view of the spout assembly of a feeding device according to FIG. 13.

Referring to FIG. 14, the spout assembly 110 includes a lower flange 118 under a base 120. Above the spout assembly base 120, and continuous with it, is a cut-out portion 122. The base 120 has a greater diameter than the peg 108, the cut-out portion 122, or the flange 118. The flange 118 snaps or otherwise plugs into the hole through the neck of the bottle portion 104. This novel feature prevents leaking when the bottle is tipped or squeezed. The outside diameter of the flange 118 matches the inside diameter of the hole in the neck. The outside of the flange 118 is convex, which enhances the seal between the flange and the inside of the top of the neck once the bottle is squeezed and the fluid begins to flow. The collar 22 is then placed over the top of the spout assembly, so that the cut-out portion 122 extends through, and fits snugly in, an aperture of the collar. The collar 22, which is threaded inside, screws onto corresponding threads on the outside of the bottle neck. Once the collar 22 is fastened, it extends down over the bottle neck. When the bottle portion is depressed by the user (person being fed or his or her caregiver) during use, the fluid in the bottle is forced up through the rigid straw 116 and then through the tubing 106, so the tubing is in fluid communication with the bottle portion. This allows a person who may not be able to move his or her head or neck to squeeze fluids up and out of the bottle via the rigid straw and the soft tubing.

Figure 15:
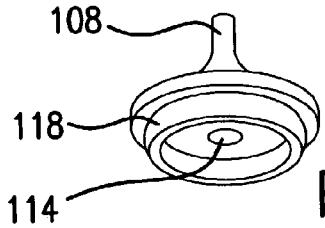
FIG. 15 shows a perspective view of the spout assembly of a feeding device according to FIG. 13.
Figure 16:
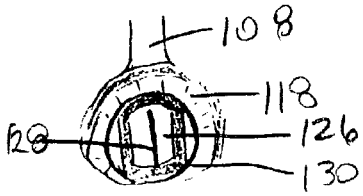
FIG. 16 shows a perspective view of a spout assembly of a feeding device according to the present invention, shown with a valve assembly.

Referring to FIGS. 15 and 16, the spout assembly 110 may further include a valve assembly 124. FIGS. 13 and 15 show the spout assembly without a valve assembly. In this embodiment, the rigid straw 116 inserted in the channel 114 allows the bottle portion to be squeezed in an upright position for feeding. With a valve assembly 124, as shown in FIG. 16, to control the flow of fluid from the bottle portion through the spout assembly, the bottle portion can also be squeezed upside down or sideways. This is especially useful for patients who are restricted from a full range of movement, such as tilting their heads back. For example, some patients are fitted with an osteogenesis distraction apparatus, which pulls the jawbone forward over time. Unfortunately, the osteogenesis distraction apparatus prevents these patients from using a cup normally. They can use the device of the present invention, though. Also, patients in a Striker frame, which moves to suspend the patient bound to it in many different positions, including an upside down position, can use the feeding device of the present invention. The feeding device allows these patients, who are often adults or teens, to feel more independent and in control.

Figure 17:
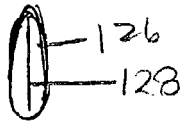
FIG. 17 shows a perspective view of a portion of a valve assembly of a feeding device according to the present invention.
Figure 18:
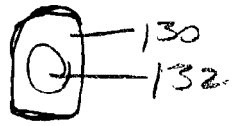
FIG. 18 shows a perspective view of a portion of a valve assembly of a feeding device according to the present invention.

As shown in FIGS. 16 through 18, a preferred embodiment of the valve assembly 124 comprises a floppy disc 126 of a rubber-like material with a slit 128 at its center. The floppy disc 126 is held within the flange by a frame 130 having a circular orifice 132 at its center through which the slit is visible. The frame 130, which has rounded edges for contacting the inside of the flange, braces the floppy disc in the lower portion of the spout assembly. The slit controls the flow of fluid from the bottle portion into the spout assembly.

Figure 19:
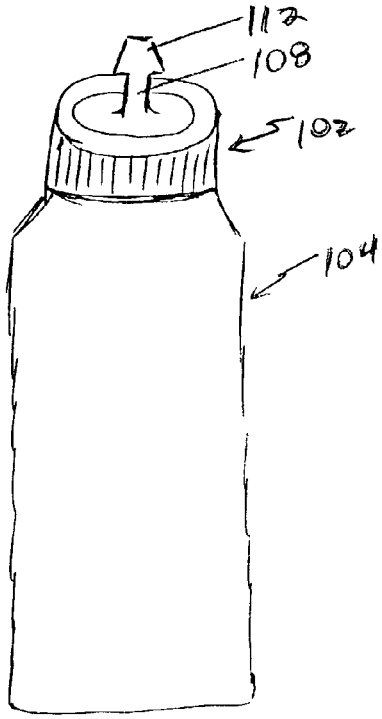
FIG. 19 shows a perspective view of a portion of a feeding device according to the present invention.

In a further alternate embodiment shown in FIG. 19, the feeding device may be used with the tubing. In a further alternate embodiment, the feeding device can be used without the rigid straw where the spout assembly is fitted with a valve assembly to control fluid flow.

In summary, the third embodiment of the present invention includes a detachable, extended spout 68 having a central bore 69 with an opening at its upper end, and a detachable collar 22, as described above and shown in FIG. 7. The extended spout 68 includes a vertically extended upper spout portion 70, with the extended spout bore 69 gradually decreasing in diameter from a wider lower bore end to a narrower upper bore end (also see FIG. 8). A lower portion of the extended spout 68 includes a flange 74 connected to a bottom surface of a base 75, the base 75 having a greater diameter than the flange 74 or the extended spout 68. As is also shown in FIG. 7, the extended upper spout portion 70 extends in a generally upward direction from a top surface of the base 75, and the flange 74 has an outside diameter generally corresponding to an inside diameter of the bottle neck 76. An interior portion of the collar 22 is engagable with an exterior portion of the bottle neck 76. In this embodiment, the collar 22 has an inside diameter generally corresponding to the outside diameter of the bottle neck 76, the base 75 has a diameter generally corresponding to the outside diameter of the bottle neck 76, and the collar aperture 20 has a diameter greater than the diameter of the lower portion of the extended spout 68 and less than the diameter of the base 75.

A generally circular valve assembly 80, 90 as shown in FIGS. 8, 9 and 11 may be inserted in the generally circular lower bore end of the extended spout 68, or in any embodiment of the present invention. Any feeding device herein may include a valve assembly 124 with a floppy disc 126, as described above and shown in FIGS. 16–18.

In the embodiments 10, 66, 77 with spouts, a length of flexible, fluid-conducting tubing 17 is insertable through the spout bore 69, 81, with an upper end portion of the tubing extending out through the upper bore end of the spout 16, 68, and a lower end portion of the tubing extending down through the lower bore end into the bottle portion 14, where it is in contact with the ingestible fluid. In the present invention, the tubing 17, 52 may have a flared lower end portion 64 for preventing the tubing from sliding through the upper bore end of the spout 16, 68 when it is wet.

In summary, the kit for feeding an ingestible fluid to a patient comprises:

(a) a bottle portion 14 of a feeding device 10, 40, 66, 77, 82, 100;

(b) flexible, fluid-conducting tubing 17, 52, 83, 106 of a length that is less than the length of the bottle portion 14;

(c) at least one spout assembly 110 or nipple assembly 42, 85 of the feeding device;

(d) at least one fluid control valve 80, 90, 124 for insertion in a lower portion of the nipple or spout assembly 42, 85, 110; and (e) a substantially rigid straw 84, 116 for use in threading the flexible tubing 17 through an orifice of a nipple 44, 86 of the nipple assembly 42, 85, or for insertion into a bore of a spout of the spout assembly 110.

As described hereinabove, the present invention also includes a method for assembling a bottle feeding device, comprising the steps of:

(a) inserting an angled upper end 89 of a substantially rigid straw 84 through a central lower space in a nipple assembly 84 up through an orifice 87 in an upper end of a nipple 86 in an upper portion of the nipple assembly 85 of the feeding device 82;

(b) threading a length of flexible, fluid-conducting tubing 83 up through the straw 84, the tubing having an outside diameter that is less than the inside diameter of the straw, and a plug 88 at its lower end for preventing the tubing 83 from slipping through the nipple orifice 87, the plug 88 having an aperture for admitting the ingestible fluid; and (c) removing the straw 84 by pulling it up through the nipple orifice 87, leaving the tubing 83 projecting from the nipple 86; and, preferably, (d) inserting a generally cylindrical-shaped fluid control valve 80, 90, 124 into a central, generally cylindrical-shaped space 91 in a lower portion of the nipple assembly;

(e) filling a bottle portion 14 of the feeding device with a desired amount of ingestible fluid; and (f) detachably attaching the nipple assembly to a neck 76 of the bottle portion. Step (f) preferably includes the substeps of: (f1) inserting the nipple assembly through a central aperture 20 in a threaded collar 22 until a first projection 93 and a second projection 97 on a lower portion of the nipple assembly 85 lodge above and below the central aperture 20; and (f2) screwing the internally threaded collar 22 onto the correspondingly threaded outside of the bottle neck 28.

In a further alternate embodiment (not shown), the soft tubing may be removed and the spout may be rounded at the top and made of a soft silicone-type material, so that it resembles a nipple. This embodiment is useful for babies for whom sucking is contraindicated (e.g., because of stitches in the mouth), and for newborns who for various reasons have not yet learned to suck to begin the learning process. The present invention provides a squeezable and leakproof way to administer and regulate fluids to convalescing babies, geriatrics, or patients of any age.

From the foregoing it can be realized that the described device of the present invention may be easily and conveniently utilized. While preferred embodiments of the invention have been described using specific terms, this description is for illustrative purposes only. It will be apparent to those of ordinary skill in the art that various modifications may be made without departing from the spirit or scope of the invention, and that such modifications are intended to be within the scope of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

BRIEF LIST OF REFERENCE NUMBERS USED IN THE DRAWINGS

| | |
|---|---|
| 10 | feeding bottle device |
| 12 | cap assembly |
| 14 | bottle portion |
| 15 | sutures |
| 16 | spout of first embodiment |
| 17 | tubing of first embodiment |
| 18 | upper spout portion |

-continued

| BRIEF LIST OF REFERENCE NUMBERS USED IN THE DRAWINGS | |
|---|---|
| 20 | collar aperture |
| 22 | threaded collar |
| 24 | lower spout portion |
| 26 | spout flange |
| 28 | threaded neck |
| 30 | spout base |
| 32 | spout band |
| 36 | flared tubing section |
| 38 | base of flared tubing section |
| 40 | second embodiment of feeding device |
| 41 | upper end of flared tubing section |
| 42 | nipple assembly of second embodiment |
| 44 | nipple of second embodiment |
| 46 | nipple flange |
| 48 | nipple band |
| 50 | tubing assembly |
| 52 | curved tubing |
| 54 | straw section |
| 56 | upper end piece of straw section |
| 58 | lower straw portion |
| 60 | sharp lower end of straw portion |
| 62 | slit in nipple |
| 64 | enlarged lower end of tubing |
| 66 | third embodiment |
| 68 | extended spout |
| 70 | extended upper spout portion |
| 71 | upper cut mark |
| 72 | middle cut mark |
| 73 | lower cut mark |
| 74 | flange on spout |
| 75 | base on spout |
| 76 | unthreaded neck |
| 77 | fourth embodiment of feeding device |
| 78 | projection for valve |
| 79 | flanged spout of fourth embodiment |
| 80 | first valve |
| 81 | orifice in valve |
| 82 | fifth embodiment of feeding device |
| 83 | tubing of fifth embodiment |
| 84 | straw of fifth embodiment |
| 85 | nipple assembly of fifth embodiment |
| 86 | nipple of fifth embodiment |
| 87 | nipple orifice |
| 88 | tubing plug |
| 89 | sharp end of straw-fifth embodiment |
| 90 | second valve |
| 91 | space for valve in nipple assembly |
| 92 | holes in second valve |
| 93 | first projection |
| 94 | corresponding groove in neck |
| 96 | neck of fifth embodiment |
| 97 | second nipple projection |
| 98 | top of bottle neck |
| 100 | sixth embodiment of feeding device |
| 102 | cap assembly |
| 104 | bottle portion |
| 106 | tubing |
| 108 | peg |
| 110 | spout assembly |
| 112 | projection |
| 114 | channel in spout assembly |
| 116 | rigid straw |
| 118 | spout assembly flange |
| 120 | spout assembly base |
| 122 | spout assembly cut-out portion |
| 124 | valve assembly |
| 126 | disc in valve assembly |
| 128 | slit in valve assembly |
| 130 | frame in valve assembly |
| 132 | orifice |

What is claimed is:

1. A squeezable feeding device for feeding an ingestible liquid to a patient, the feeding device comprising:

a) a squeezable bottle portion for holding the ingestible liquid therewithin, the bottle portion comprising an opening at its top surrounded by a neck; and b) a cap assembly comprising: flexible fluid-flow tubing, a separate spout or nipple assembly, and a detachable collar, an upper portion of the spout or nipple assembly being insertable through a central aperture in the collar, the flexible tubing having a first end in fluid communication with the bottle portion and a second end insertable in the patient's mouth, the flexible tubing extending through a central aperture in the spout or nipple assembly, the collar extending in a downward direction over the neck of the bottle portion, an interior portion of the collar being engagable with an exterior portion of the neck; and further comprising a separate flared tubing section at a lower end of the flexible tubing, the flared tubing section comprising a central aperture that is wider at a base of the flared tubing section than at an opposite, upper end of the flared tubing section, the flexible tubing being insertable through the flared tubing section aperture, the diameter of the aperture at the upper end of the flared tubing section closely corresponding to an outer diameter of the flexible tubing.

2. A squeezable feeding device for feeding an ingestible liquid to a patient, the feeding device comprising:

a) a squeezable bottle portion for holding the ingestible liquid therewithin, the bottle portion comprising an opening at its top surrounded by a neck; and b) a cap assembly comprising: flexible fluid-flow tubing, a separate spout or nipple assembly, and a detachable collar, an upper portion of the spout or nipple assembly being insertable through a central aperture in the collar, the flexible tubing having a first end in fluid communication with the bottle portion and a second end insertable in the patient's mouth, the flexible tubing extending through or encircling a central aperture in the spout or nipple assembly, the collar extending in a downward direction over the neck of the bottle portion, an interior portion of the collar being engagable with an exterior, portion of the neck; and further comprising a separate flared tubing section at a lower end of the flexible tubing, the flared tubing section comprising a central aperture that is wider at a base of the flared tubing section than at an opposite, upper end of the flared tubing section, the flexible tubing being insertable through the flared tubing section aperture, the diameter of the aperture at the upper end of the flared tubing section closely corresponding to an outer diameter of the flexible tubing for preventing the flexible tubing from slipping through an upper end of the spout aperture;

wherein the flared tubing section is not a part of the spout assembly; and wherein the flexible tubing is disposable and extendible through the central aperture in a spout of the spout assembly.

3. The feeding device according to claim 2, wherein the collar comprises interior threading engageable with corresponding threading on the exterior portion of the neck of the bottle portion.

4. A squeezable feeding device for feeding an ingestible liquid to a patient, the feeding device comprising:

a) a squeezable bottle portion for holding the ingestible liquid therewithin, the bottle portion comprising an opening at its top surrounded by a neck; and b) a cap assembly comprising: flexible fluid-flow tubing, a separate spout or nipple assembly, and a detachable collar, an upper portion of the spout or nipple assembly being insertable through a central aperture in the collar, the flexible tubing having a first end in fluid communication with the bottle portion and a second end insertable in the patient's mouth, the flexible tubing extending through or encircling a central aperture in the spout or nipple assembly, the collar extending in a downward direction over the neck of the bottle portion, an interior portion of the collar being engagable with an exterior portion of the neck;

wherein the nipple or spout assembly comprises a nipple or spout on its upper portion and a flange on its lower portion, the flange extending closely into the open top of the bottle portion, the upper nipple or spout portion extending through the collar aperture, the lower nipple or spout portion remaining within the collar.

* * * * *